United States Patent [19]

Perez et al.

[11] Patent Number: 4,793,370

[45] Date of Patent: Dec. 27, 1988

[54] CRUTCH CAST SUPPORT

[76] Inventors: Ignacio Perez, 2835 SW. 6th St., Miami, Fla. 33135; Stephen M. Calderon, 7301 SW. 100 Ct., Miami, Fla. 33173

[21] Appl. No.: 56,905

[22] Filed: Jun. 3, 1987

[51] Int. Cl.[4] ..... A61H 3/02

[52] U.S. Cl. ..... 135/69; 135/65; 135/68

[58] Field of Search ..... 135/65, 66, 67, 68, 135/69, 70, 71, 72, 75, 76, DIG. 9, DIG. 10, DIG. 11; 128/94; 297/4, 5, 6, 7

[56] References Cited

U.S. PATENT DOCUMENTS 1,611,807 12/1926 Bergh ..... 297/6
3,538,512 11/1970 Dolan ..... 297/4

FOREIGN PATENT DOCUMENTS 250085 of 0000 Australia ..... 297/5
23046 of 0000 France ..... 297/4

*Primary Examiner*—Richard J. Johnson
*Assistant Examiner*—Charles H. Sam
*Attorney, Agent, or Firm*—Oblon, Fisher, Spivak, McClelland & Maier

[57] ABSTRACT

A crutch cast support or crutch leg support is provided by a loop of flexible material attached to a crutch at a location of the crutch that is closer to a shoulder support of the crutch than to a hand hold of the crutch, the loop of flexible material hanging loosely from a mounting mechanism that mounts the loop to the crutch. Preferably, the mounting mechanism provides three degrees of freedom where the loop is mounted to the crutch to enhance swinging motion of the loop in a walking direction with respect to the crutch, in a direction transverse to the walking direction, and in rotation about an axis disposed in a longitudinal direction of the crutch. The loop of flexible material is provided by a strap, the length of which is adjustable, so that a leg of a user may be supported at a wide variety of places including the area of the knee, a location closer to the ankle than to the knee, and from below the foot.

14 Claims, 3 Drawing Sheets

CRUTCH CAST SUPPORT

BACKGROUND OF THE INVENTION

1. Field of the Invention:

The invention pertains to a leg support attached to a crutch and has particular application to, but is not limited to, supporting the leg of a user who has been fitted with any of a variety of leg casts.

2. Discussion of the Background:

As shown in U.S. Pat. No. 2,543,847 of Hallstedt, it is known to provide a sling, worn by a user, to keep a leg of the user constantly elevated in order to provide "perfect relief" from weight-bearing so that the user may recover from a unilateral leg disease such as Legg-Perthes disease. Such constant elevation may not be necessary for ordinary users of crutches, for example, those recovering from a broken bone or lesion. In such cases, e.g., when one merely desires assistance in supporting the weight of a cast, the constant restraint created by such a sling and the extra manipulation required when standing or sitting may be cumbersome.

The patent of Hallstedt contemplates that the sling will be used together with a conventional pair of crutches. Others have actually attached various forms of leg supports to crutches. Frequently, the leg support is maintained in a substantially fixed position with respect to the crutch, so that the resulting apparatus either is not designed for supporting the leg during the act of walking or, if it is intended for supporting the leg while walking, the leg must nevertheless follow the crutch closely, so that walking becomes cumbersome. Examples are U.S. Pat. No. 2,378,486 of Jones, U.S. Pat. No. 2,778,370 of Chamblee, U.S. Pat. No. 4,291,715 of Monte and U.S. Pat. No. 2,678,054 of Bostelman. Another characteristic of such inventions is that the leg support is often a rigid member and is attached to the crutch at a fairly low position, such as below the hand grip. This adds to the weight that the user must swing when repositioning the crutch and, to that extent, adds undesirable momentum to the crutch at a critical time during its operation, i.e., when the user is preparing to plant the crutch in a new position.

In addition, hardware mounted to the crutch in a manner described above can sometimes get in the way when it is not in use and is often in a position to be bumped unintentionally by the user.

In some cases, for example the patent of Chamblee, the leg support, when mounted on the crutch, is unsuitable for immediate use either with a left leg or a right leg, but not both. The apparatus must be reconfigured in order to change legs.

Where the knee support is substantially curved or otherwise configured to receive a knee or a leg, the configuration may not be appropriately sized or shaped to receive either a leg having a cast or a leg not having a cast.

Some but not all of the above-noted disadvantages have been at least partly addressed in U.S. Pat. No. 2,585,730 of Bodnar. In particular, there is provided a standard 18 that is pivoted to the shoulder rest 12 of the crutch by a pivot pin 16. Accordingly, the invention of Bodnar can accommodate leg motion during walking. However, there is still provided a solid member that constrains the motion of the leg to a single direction when the leg is moving forward and constrains the motion of the crutch when the crutch is being moved forward. That is, no provision is made for transverse motion of the standard 18 with respect to the crutch 10, and once a motion has begun, either it must be carried through to its completion in the same direction in which it was initiated or the user must attempt to pivot the crutch at its tip. Accordingly, any unintentional leg movement that may occur during the operation of lifting tee crutch, moving it forward and then placing the crutch on the walking surface may jerk the crutch into an unintended position. I addition, the standard 18 may be unwieldy when not in use.

SUMMARY OF THE INVENTION

The current invention is drawn to a crutch having a shoulder rest and a hand hold; leg supporting means comprising a loop of flexible material; and mounting means attaching the loop of flexible material to the crutch at a location thereof that is closer to the shoulder support than to the hand hold, the loop of flexible material hanging loosely from the mounting means.

In attaching a loop of flexible material at an upper portion of a crutch, the current invention addresses the above-noted and other disadvantages. It provides increased ease of use, comfort, safety and versatility of use.

It is an object of the current invention to provide a leg support attached to the crutch which can support a leg either in the area of a knee, in an area closer to the ankle than to the knee, or at the bottom of the foot.

It is a further object of the current invention to provide a leg support attached to a crutch in which the place at which the leg is supported can easily be moved to support a variety of casts having different centers of gravity.

A still further object of the current invention is to provide a leg support attached to a crutch in which the leg being supported may move freely and substantially independently of the crutch.

An additional object of the current invention is to provide a leg support attached to a crutch in which the act of lifting, moving and lowering the crutch does not require concurrent swinging of the leg support.

Yet another object of the current invention is to provide a leg support attached to a crutch that provides the above-noted advantages and may be used to support either a left leg or a right leg without adjustment.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
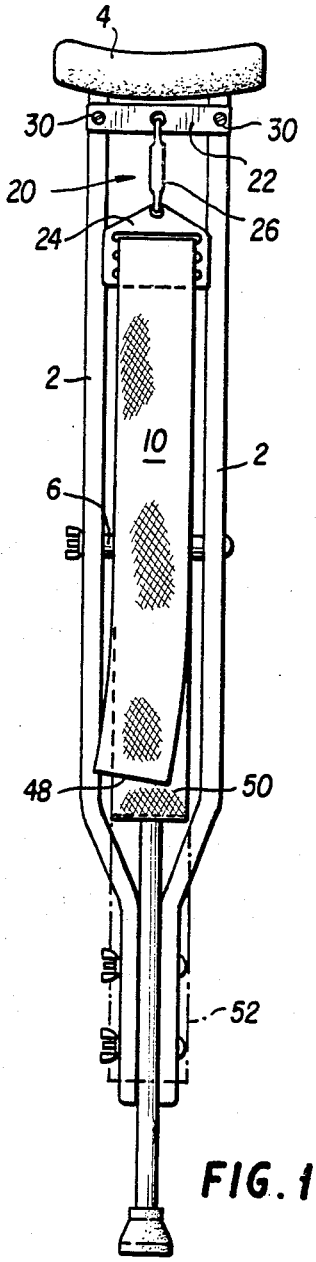
FIG. 1 is a front elevation of a preferred embodiment according to the current invention, wherein an adjusted position of the flexible loop is shown in phantom.

Referring now to the drawings, wherein like reference numerals designate identical or corresponding parts throughout the several views, and more particularly to FIG. 1 thereof, there is shown a crutch including a pair of side pieces 2, a shoulder rest 4 and a hand hold 6. A strap 10 of flexible material is attached to the crutch by mounting means 20. The strap 10 may be made of a material that is known per se and is preferably made of a reinforced woven fabric. As will be described below, the strap 10 forms a loop 50 that hangs loosely from the mounting means 20 and is of an adjustable length.

Figure 2:
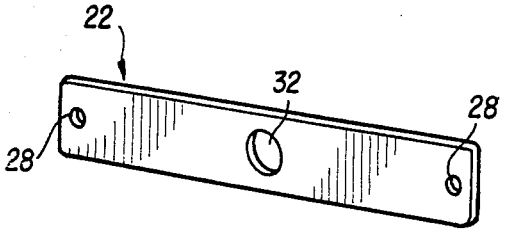
FIG. 2 is a perspective view of a first member of mounting means according to the preferred embodiment.
Figure 3:
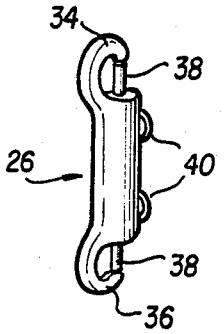
FIG. 3 is a perspective view of a third member of mounting means according to the preferred embodiment.
Figure 4:
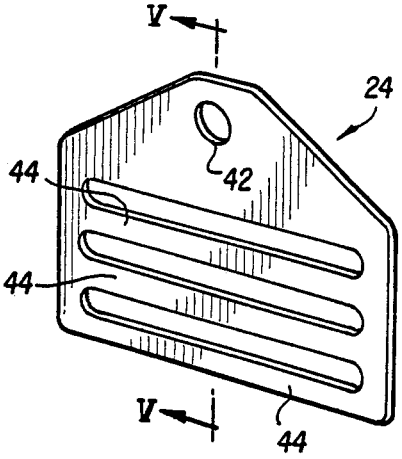
FIG. 4 is a perspective view of a second member of mounting means according to the preferred embodiment.

Preferably, the mounting means 20 includes mounting screws or bolts 30 or the like and first, second and third members. In the preferred embodiment, the first member is in the form of a mounting plate 22 as shown in FIG. 2, the second member is in the form of an adjusting plate 24 as shown in FIG. 4, and the third member is in the form of a double hook 26, as shown in FIG. 3.

The mounting plate 22 is formed with a pair of holes 28 for receiving the screws 30, the screws 30 respectively fixing the mounting plate 22 to the side pieces 2 of the crutch. Mounting plate 22 also is formed with a pivoting opening 32 for receiving an upper hook 34 of the double hook 26.

The adjusting plate 24 includes a pivoting opening 42 for receiving a lower hook 36 of the double hook 26. Adjusting plate 24 further comprises a plurality of cross-pieces 44 that form a plurality of slots, the slots receiving a first end 46 (FIG. 5) of the strap 10 and a second end 48 of the strap 10, as will be described below.

The double hook 26 preferably includes spring-loaded extensible closures 38 which are operable by pushes 40, or the equivalent thereof, for closing openings of the upper and lower hooks 34, 36 to form complete closed loops. It is preferred for the dimensions of the pivoting openings 32, 42 to be substantially larger than the thicknesses of the upper and lower hooks 34, 36 that are respectively received in those openings. Such dimensions provide for a preferred form of pivotal connection between the mounting plate 22 and double hook 26 on the one hand, and between the adjusting plate 42 and the double hook 26 on the other hand. In particular, each of these pivotal connections provides three degrees of freedom. For example, the double hook 26 may pivot about the opening 32 in a first direction parallel to the waling direction of the crutch (i.e., parallel to the plane of the cross pieces 2), in a second direction transverse to the walking direction of the crutch, and in rotation about a longitudinal axis of the crutch (i.e., about an axis substantially parallel to the lengths of the cross pieces 2). In similar fashion, the pivoting connection between the adjusting plate 24 and the double hook 26 also provides three degrees of freedom.

Figure 5:
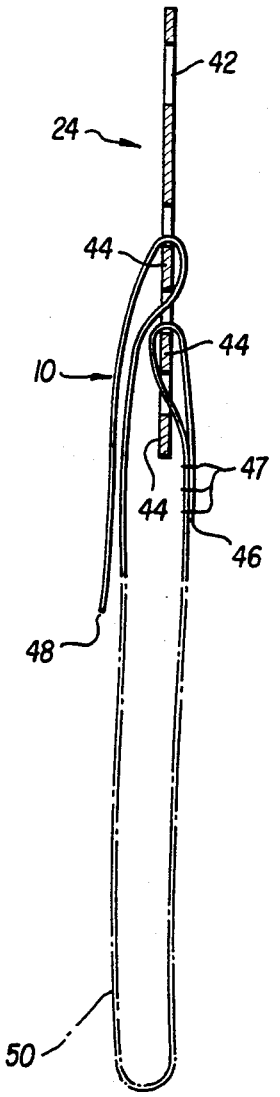
FIG. 5 is a side elevational cross-section illustrating a manner of attachment of the loop of flexible material to the second member, the view of the second member being taken on line V—V of FIG. 4.

FIG. 5 illustrates one manner in which the strap 10 may cooperate with the adjusting plate 24 to provide a loop 00 of varying length. A first end 46 of the strap 10 is attached to the adjusting plate 24 by being wrapped about one of the cross-pieces 44 and then fixed to the strap, as by stitching 47. A second end 48 of the strap is looped about another of the cross-pieces 44 and hangs loosely. It may be seen that structure of this type allows one to adjust the length of the loop 50, a portion of this loop being shown in phantom in FIG. 5. For example, the length of the loop 50 may be adjusted between a shorter length as shown in solid line in FIG. 1 and a longer length shown in phantom in FIG. 1 and designated by reference numeral 52.

Figure 6:
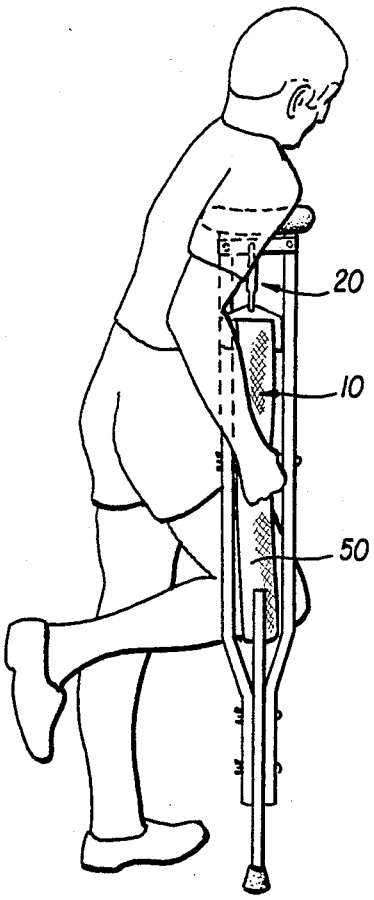
FIG. 6 is a front elevation showing the preferred embodiment in use to support a leg in the area of a knee.

One mode of use of the current invention will now be described with reference to FIG. 6. The user has elected to provide leg support in the area of the knee, and for this purpose has adjusted the length of the loop 50 to a shorter length. In FIG. 6, the invention is being used by an individual who has not been fitted with a cast. However, it will be understood that the invention may be used in this configuration by an individual who has been fitted with a cast. It is contemplated that the user may desire to use a conventional crutch for the left hand and left shoulder.

Figure 7:
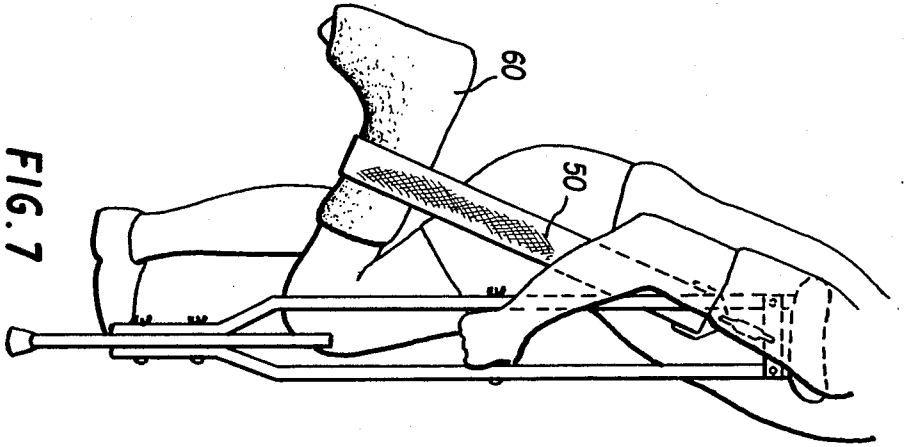
FIG. 7 is a front elevation showing the preferred embodiment in use to support a cast in an area closer to the ankle than to the knee of a user.

In FIG. 7, the user has elected to provide leg support in a region of the leg that is closer to the ankle than to the knee. Because the flexible loop is attached to the crutch at a location that is high on the crutch, e.g., at a location that is closer to the shoulder rest 4 than to the hand hold 6, the configuration shown in FIG. 7 is easily achieved merely by lengthening the loop 50.

One occasion in which a user may desire to use the configuration shown in FIG. 7 would be when the user has been fitted with a cast 60, as shown, which extends from a point below the knee to a point at or beyond the ankle, perhaps even encompassing the foot. When the user is in a comfortable standing or walking position, the center of gravity of the cast is disposed well rearwardly of the crutch, and the rearwardly extending loop 50 therefore provides improved support.

Figure 8:
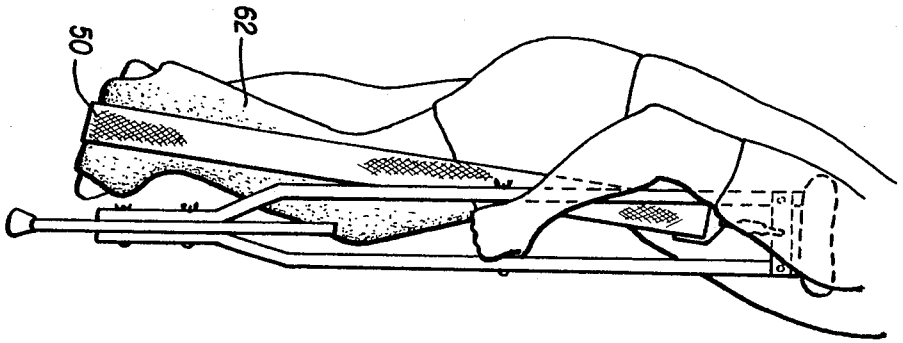
FIG. 8 is a front elevation showing the preferred embodiment in use to support a cast at a point below the foot of a user.

In the configuration shown in FIG. 8, the injury of the user is such that some of the weight of the user may be borne from beneath the foot. Again, because the strap is mounted high on the crutch, this configuration may be achieved by the simple expedient of lengthening the loop 50.

Depending upon the needs and desires of the user, the leg support provided by the current invention may be used while the user is walking, or standing still, or both. Because the strap 10 is made of a flexible material, and because it is mounted high on the crutch, mos preferably immediately below the shoulder rest 4, it will not provide substantial interference with a user who desires not to use it on a particular occasion. For example, a user who desires to use the strap 10 only for support while standing still can either let it hang in place while walking or, if preferred, can even flip it through the space above the hand hold 6 to the outside face of the crutch. Moreover, if the user experiences muscle fatigue or cramping with the strap disposed in one configuration, such as that of FIG. 6, the user can temporarily convert the configuration of support to a different configuration, such as that shown in FIG. 7.

Because the strap 10 is made of a wide, flexible material and is mounted high on the crutch, the strap provides a substantial amount of "play" and exhibits little or no tendency to cause frictional problems by rubbing along the leg of the user, if the user has not been fitted with a cast.

In the preferred embodiment, the above-noted advantages resulting from the use of a flexible strap mounted high on the crutch are enhanced by the use of a pivotal mounting between the strap and the crutch, and are especially enhanced by the provision of a pivotal mounting allowing for three degrees of freedom. Such a mounting provides great isolation between the point of support of the leg and the motion of the crutch.

It may now be seen that the current invention, in providing for a flexible strap mounted from a high point on a crutch, provides support for a leg at a variety of points, such as the forward portion near the knee and also a rearward portion closer to the ankle In walking, the effect of forward crutch swinging movement either is not transmitted to the affected leg, or is only slightly transmitted to the affected leg, thereby providing for improved safety and ease of use. During walking, when the leg itself is swinging forward, the crutch is firmly planted on the walking surface. Moreover, the element that actually supports the leg, i.e., the strap 10, moves forward only when the leg moves forward, and not when the crutch moves forward. This avoids the extra momentum that is added to certain of the prior art devices, in which the leg support must be moved unitarily with the crutch.

The flexible strap is light in weight, thereby even further diminishing this momentum problem, and does not get in the way of a user who temporarily does not wish to us it. The flexibility of the strap allows for additional relative motion between the crutch and the leg, and therefore the leg is not subjected to undesirable and unintended jerks when the crutch is being moved. Because the strap is mounted high on the crutch, this advantage is enhanced with increasing loop length.

The flexible strap of the current invention, unlike the rigid crutch-mounted leg supports of the prior art, presents no danger of injury to the user or the surroundings of the user from unintentional bumps and scrapes, especially on those occasions when the crutch is just being put into use or being set aside. The flexible strap, because of the length of the loop, conforms immediately to all sizes of leg, with or without a cast. Where no cast is used, the user is provided with enhanced comfort and freedom from skin irritation, because essentially no relative movement occurs between the strap and the leg of the user.

The high-mounted flexible strap of the current invention can immediately be moved to either side of the crutch. Not only does this provide an additional convenience for a user who may, on a particular occasion, desire not to use the strap 10, but this feature also can be of substantial use in a hospital or similar rehabilitative setting in which a medical facility has possession of several crutches with leg support according to the current invention. In particular, the invention may be used immediately with an injured right leg or an injured left leg, without the necessity of dismounting and remounting any portion of the apparatus to accommodate a left leg or a right leg.

By providing an adjustable length loop, any portion of th leg from at or below the knee may be supported, including the bottom of the foot. A continuous adjustment, as disclosed, is not limited by pre-drilled holes or the like and provides for a quick and easy adjustment.

Where the mounting means provides three degrees of freedom, as in the disclosed and preferred embodiment, the top of the loop may immediately move to any orientation with respect to the shoulder support of the crutch. This further diminishes any effect of crutch movement on the affected leg and allows for greater range of motion of the body and the affected leg with respect to the crutch. This can be of substantial benefit both in walking and standing still. For example, when standing still, the user can slightly pivot or reposition the body with respect to the crutch without having to suffer the annoyance of the crutch's following every little motion of the body. Furthermore, such provision of three degrees of freedom provides even greater safety and ease of use in tee act of raising, moving and lowering the crutch when walking.

The loop of flexible material may be fixed directly to the crutch, without provision for pivoting. The second member 24 may be attached to the crutch for motion about a single axis, in which case the first member of the mounting means could be a bolt or the like providing only one degree of freedom in the pivoting. In another form, the third member of the pivoting means (double hook 26) may be eliminated, and the second member (adjusting plate 24) may be pivotally attached to the first member (mounting plate 22), thereby again providing only one degree of pivoting motion. All of these modifications are less desirable than the preferred and disclosed embodiment, because they restrict the freedom of pivoting and therefore provide for less freedom of movement of the strap 10 with respect to the crutch. Moreover, it is preferred to use the mounting plate 22, because the use of such a plate enhances attachment to a standard crutch.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. In combination:

a crutch having a shoulder rest and hand hold;

leg support means comprising a loop of flexible material extending to a position below said hand hold; and mounting means for attaching said loop of flexible material to said crutch at a location thereof that is closer to said shoulder support than to said hand hold and for loosely attaching said loop of flexible material from said mounting means.

2. The combination of claim 1, wherein said mounting means further comprises an adjusting member, and said loop of flexible material is provided by a strap of said flexible material, a first end of said strap being attached to said adjusting member, a second end of said strap being adjustably received by said adjusting member, said adjusting member comprising means for adjusting the length of said loop.

3. The combination of claim 1, wherein said mounting means further comprises at least a first member fixed on said crutch, a second member supporting said loop, and at least one pivot means providing relative motion of said second member with respect to said first member.

4. The combination of claim 3, wherein said second member is in the form of an adjusting plate having a plurality of slots formed therein and said loop of flexible material is provided in the form of a strap of said flexible material, a first end of said strap being attached to said plate, a second end of said strap being adjustingly received in said slots, wherein said plate comprises means for adjusting the length of said loop.

5. The combination of claim 3, wherein said first member further comprises a mounting plate fixed on said crutch, said mounting plate having a hole formed therein, said at least one pivot means being received in said hole.

6. The combination of claim 3, wherein said mounting means further comprises a third member connected at a first portion thereof to said first member and connected at a second portion thereof to said second member.

7. The combination of claim 6, wherein said third member is pivotally connected to said first member.

8. The combination of claim 6, wherein said third member is pivotally connected to said second member.

9. The combination of claim 1, wherein said mounting means further comprises at least a first member fixed on said crutch, a second member supporting said loop, and pivot means providing relative motion with three degrees of freedom of said second member with respect to said first member.

10. The combination of claim 9, wherein said second member is in the form of a plate having a plurality of slots formed therein and said loop of flexible material is provided in the form of a strap of said flexible material, a first end of said strap being attached to said plate, a second end of said strap being adjustably received in said slots, wherein said plate comprises means for adjusting the length of said loop.

11. The combination of claim 9, wherein said first member further comprises a mounting plate fixed on said crutch, said mounting plate having a hole formed therein, said at least one pivot means being received in said hole.

12. The combination of claim 9, wherein said mounting means further comprises a third member connected at a first portion thereof to said first member and connected at a second portion thereof to said second member.

13. The combination o claim 12, wherein said third member is pivotally connected to said first member by pivot means providing relative motion with three degrees of freedom therebetween.

14. The combination of claim 12, wherein said third member is pivotally connected to said first member at pivot means providing relative motion with three degrees of freedom therebetween.

* * * * *